US005255575A

United States Patent [19]

Williams

[11] Patent Number: 5,255,575

[45] Date of Patent: Oct. 26, 1993

[54] MULTI-PURPOSE HAND TOOL

[76] Inventor: Michael D. Williams, Box 350, Sedalia, Colo. 80135

[21] Appl. No.: 905,828

[22] Filed: Jun. 29, 1992

[51] Int. Cl.[5] ..... B25D 1/02

[52] U.S. Cl. ..... 81/25; 81/26

[58] Field of Search ..... 81/25, 26, 185.1, 20; 403/354, 381

[56] References Cited

U.S. PATENT DOCUMENTS

| | | | |
|---|---|---|---|
| 235,244 | 12/1880 | Howe | 81/25 X |
| 1,121,085 | 12/1914 | Fitzgerald | 81/25 |
| 1,523,781 | 1/1925 | Keyes | 81/25 X |
| 1,784,683 | 12/1930 | Schweigert | 81/25 |
| 1,807,347 | 5/1931 | Schweigert | 81/25 |
| 2,018,573 | 10/1935 | Richardson et al. | 81/25 |
| 2,423,189 | 7/1947 | Honhart | 81/25 X |
| 2,501,757 | 3/1950 | Cagle | 81/25 X |

*Primary Examiner*—D. S. Meislin

[57] ABSTRACT

A hammer with interchangeable head and tail tool pieces where the head and tail pieces are inserted into tool voids in opposite ends of the hammer body and further having a removal pin for insertion into additional voids in the hammer body for urging the head and tail pieces out of the tool voids.

5 Claims, 1 Drawing Sheet

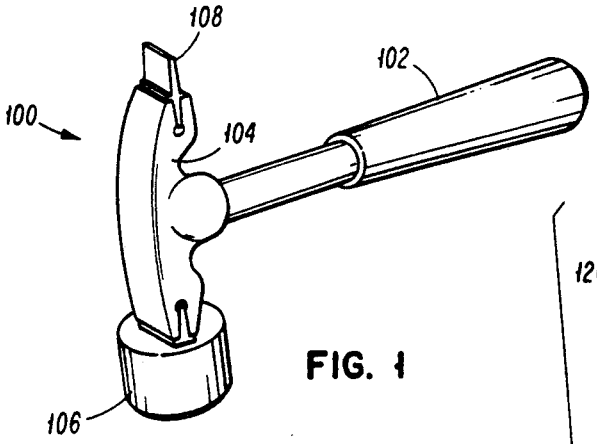
FIG. 1
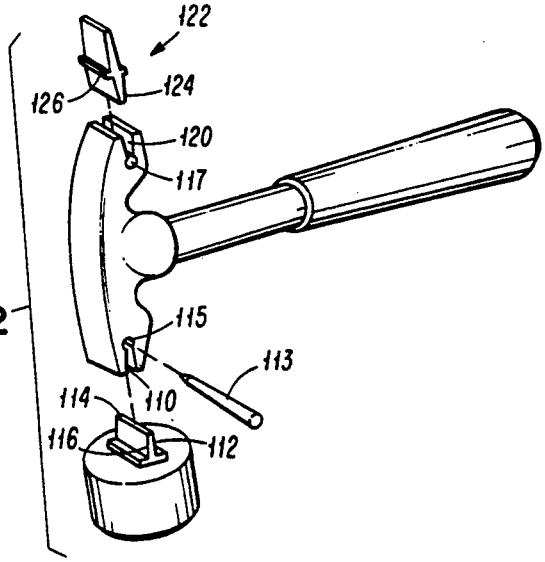
FIG. 2
FIG. 3A
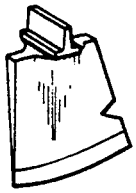
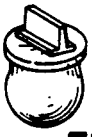
FIG. 3C
FIG. 3B
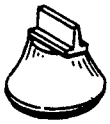
FIG. 3D
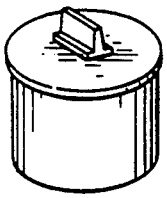
FIG. 3E
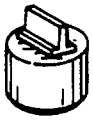
FIG. 3H
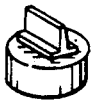
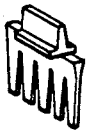
FIG. 3G
FIG. 3F
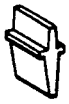
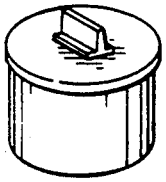
FIG. 3I
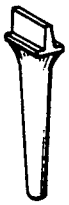
FIG. 3J
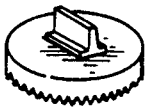
FIG 3K
FIG. 3L
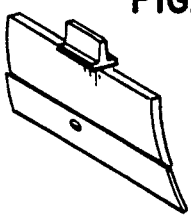
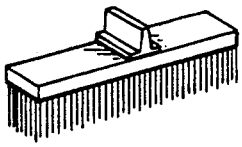
FIG. 3M
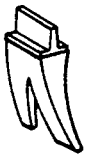
FIG. 3N

MULTI-PURPOSE HAND TOOL

BACKGROUND OF THE INVENTION

This invention relates to hand tools and more specifically relates to multi-purpose hand tools and even more specifically relates to a multi-purpose hammer having the capability of being used with a variety of interchangeable attachments for the hammer head and tail.

For years, serious craftsman have be the only major segment of modern society that have typically owned and used a very wide variety of different types of hammers. A serious handy man may have a carpenter's claw hammer, a dry wall hammer, a ball peen hammer, a brick hammer, a magnetic tack hammer, a finish hammer, and a rubber mallet, among others. These hammers are individually expensive and a large assortment may cost hundreds of dollars. Additionally, it requires a considerable amount of space on the typical handyman's workbench to store a large collection of hammers. Moreover, if the workman carries his or her tools in a tool box the size and weight of the hammers restrict the workman from carrying a large assortment of hammers easily. If a workman is using several different hammer types in a short period of time it may be uncomfortable for the workman to switch between hammers because she has become accustomed to the one hammer handle that he most recently used. This hammer confusion can result in an improper swing resulting in a damaged workpiece or even in injury to the workman.

Consequently, a need exists for an improved hammer which avoids some of the drawbacks associated with owning, storing, carrying and using a wide variety of different hammer types.

SUMMARY OF THE INVENTION

It is an object of the present invention to provide for an improved multi-purpose hammer.

It is a feature of the present invention to include a hammer having an assortment of different interchangeable hammer heads and tails for different uses.

It is an advantage of the present invention to provide an assortment of different hammer heads and tails that are interchangeable and useful upon a single hammer handle.

The present invention provides a multipurpose hammer which is designed to satisfy the aforementioned need, provide the previously propounded object, include the above described feature, and achieve the earlier articulated advantage. The invention is carried out in a "multiple hammer-less" fashion, in the sense that the large numbers of separate hammers, each with a hammer handle, a hammer body and a hammer head can be eliminated. Instead, a single hammer handle and hammer body combination is used, together with a an assortment of different interchangeable hammer heads and tails to provide the same functionality as a collection of separate complete hammers.

Accordingly, the present invention includes a hammer having a single hammer handle, a single hammer body attached to the hammer handle and a plurality of different hammer heads and tails which attach to the hammer body.

BRIEF DESCRIPTION OF THE DRAWINGS

FIG. 1 is a perspective view of a hammer handle and hammer body of a preferred embodiment of the present invention together with a rear hammer tail and a front hammer head in the appropriate positions.

FIG. 2 is an exploded perspective view of a hammer of the present invention.

FIGS. 3A–3N are perspective views of hammer heads and tails of a preferred embodiment of the present invention.

DETAILED DESCRIPTION

In the following detailed description and drawings, it is understood that like reference numerals refer to like objects throughout.

Now, referring to FIG. 1, there is shown the hammer of the present invention, generally designated 100, having a hammer handle 102, a hammer body 104, a hammer head 106, and a hammer tail 108. Preferably the hammer handle 102 is shaped to fit comfortably in the human hand and is constructed of a rigid and durable material such as wood or fiberglass, but any suitable material for a hand tool handle may be substituted. Preferably the hammer body 104 is shaped to receive a hammer handle and is constructed of a very rigid and very durable material, such as steel, iron, aluminium or other similar metal, but any suitable material may be substituted. Hammer head 106 and hammer tail 108 may be constructed of various materials depending upon their particular function.

Now referring to FIG. 2 there is shown an exploded perspective view of the hammer 100 of the present invention. Hammer body 104 is shown having a hammer head receiving slot 110 therein for receiving the hammer head tip 112 therein. Preferably hammer head tip 112 has a hammer head body end 114 and a hammer head head end 116 with body end 114 having a smaller thickness than head end 116. Slot 110 preferably is tapered to receive the tip 112 securely and it is disposed adjacent head void 115 which preferably has a dimension slightly larger than removal pin 113, but sufficiently small so that pin 113 will not fall through void 115 when tip 112 is fully inserted in slot 110. Removal pin 113 is preferably a durable tapered pin which can be hammered into void 115 and will urge tip 112 out of tapered slot 110 and will slide through void 115 when tip 112 is displaced. Also shown is tail receiving slot 120 for receiving tail tip 122 having tail tip body end 124 and tail tip tail end 126 which is preferably thicker than tail tip body end 124. Tail receiving slot 120 is tapered in a similar fashion to slot 110 in order to securely receive tail tip 122. Tail receiving slot 120 is preferably located on opposite sides of body 104 from head receiving slot 110 and is also adjacent tail void 117, which is similar to head void 115.

Now referring to FIGS. 3A–3N there is shown numerous interchangeable heads and tails each with a tip thereon for insertion into either the tail receiving slot 120 or the head receiving slot 110. It is preferred that the tips of the hammer heads and tails are constructed of the same or similar material as the the hammer body 104. If the tips and the hammer body 104 are not of an identical material it is preferred that the the different materials used have similar thermal expansion properties. FIG. 3A is a dry wall hatchet head. FIG. 3B is a dry wall hammer head. FIG. 3C is a ball peen hammer head. FIG. 3D is a rubber mallet head. FIG. 3E is a carpenters hammer head. FIG. 3F is a brick hammer tail. FIG. 3G is a scraper head or scraper tail. FIG. 3H is a finish hammer head. FIG. 3I is a leather mallet head.

FIG. 3J is a magnetized tack head. FIG. 3K is a meat tenderizer head. FIG. 3L is a paint scraper head or a paint scraper tail. FIG. 3M is wire brush head or wire brush tail. FIG. 3N is a nail puller tail.

It is thought that the hammer of the present invention, and many of its attendant advantages, will be understood from the foregoing description, and it will be apparent that various changes may be made to the form, construction and arrangement of the parts thereof without departing from the spirit and scope of the invention, or sacrificing all of its material advantages, the form herein before described being merely preferred or exemplary embodiments thereof. It is the intention of the appended claims to cover all such changes.

I claim:

1. An improved hand held hammer comprising:

a hammer body, having a first side and a second side disposed on opposite sides of the hammer body coupled with a hammer handle;

said hammer body having a head end with a free end surface and a tail end disposed opposite each other;

said hammer body having a hammer head void therein disposed within said head end and extending from said first side said void having a tapered shape with a wider dimension at said free end surface, to said second side, and further having a tail end void therein disposed at said tail end and extending from said second side to said first side;

a hammer head having a hammer head tip thereon for insertion into said hammer head void; and, a hammer tail having a hammer tail tip thereon for insertion into said tail end void.

2. A hammer of claim 1 wherein said hammer head tip has a tip end and a head end and said head end having a greater thickness than said tip end.

3. A hammer of claim 2 wherein said hammer tail tip has a tail tip end and a tail tail end with the tail tail end having a greater thickness than said tail tip end.

4. A hammer of claim 3 wherein said hammer head void has a pin receiving void disposed opposite said free end surface.

5. A hammer of claim 4 further comprising a removal pin disposed in said pin receiving void.

* * * * *